US005850247A

United States Patent [19]

Hamada et al.

[11] Patent Number: 5,850,247

[45] Date of Patent: Dec. 15, 1998

[54] IMAGE FORMING APPARATUS

[75] Inventors: Shuta Hamada; Satoshi Haneda; Hisayoshi Nagase; Hiroyuki Tokimatsu; Masahiro Onodera, all of Hachioji; Toshihide Miura, Koganei, all of Japan

[73] Assignee: Konica Corporation, Tokyo, Japan

[21] Appl. No.: 798,486

[22] Filed: Feb. 10, 1997

[30] Foreign Application Priority Data

Feb. 16, 1996 [JP] Japan ..... 8-029399

[51] Int. Cl.[6] ..... G03G 13/04; B41J 2/447

[52] U.S. Cl. ..... 347/241; 347/134

[58] Field of Search ..... 347/238, 237, 347/239, 241, 134

[56] References Cited

U.S. PATENT DOCUMENTS

| | | | |
|---|---|---|---|
| 4,839,672 | 6/1989 | Reinten | 347/238 |
| 5,262,798 | 11/1993 | Reinten | 347/238 |
| 5,371,525 | 12/1994 | Murano | 347/134 |

FOREIGN PATENT DOCUMENTS 5-307307 11/1993 Japan .

*Primary Examiner*—N. Le
*Assistant Examiner*—Lamson D. Nguyen
*Attorney, Agent, or Firm*—Frishauf, Holtz, Goodman, Langer & Chick

[57] ABSTRACT

An image forming apparatus having an exposure optical system provided with an exposure light source in which light-emitting elements are arranged on a base plate to be line-shaped and with a lens array of a distributed refractive index type that converges a beam emitted from the exposure light source on the surface of a photoreceptor and conducts imagewise exposure. The apparatus is configured to satisfy the expression:

$$\left| \Delta T1 \times \left\{ R \times \alpha - \sum_i (Ri \times \alpha i) \right\} \right| \leqq F\ (\mu m)$$

In the expression, ΔT1 represents a variation width (K) of the temperature in the vicinity of light-emitting elements, R represents a radius of the photoreceptor mentioned above, Ri represents a length (μm) of each member constituting the exposure optical system in the radial direction of the photoreceptor, α represents a coefficient of linear thermal expansion (°C.$^{-1}$) of a transparent base that forms the photoreceptor, αi represents a coefficient of linear thermal expansion (°C.$^{-1}$) of each member that constitute the exposure optical system, and F represents the depth of focus (μm) of the lens array.

11 Claims, 3 Drawing Sheets

IMAGE FORMING APPARATUS

BACKGROUND OF THE INVENTION

The present invention relates to an image forming apparatus such as a copying machine employing an electrophotographic system, a printer and a facsimile machine, and in particular, to an image forming apparatus wherein there are arranged, around a photoreceptor, a plurality of charging units, imagewise exposure units and developing units, and thereby toner images are superimposed and a color image is formed while the photoreceptor makes one turn.

As an example of an image forming apparatus employing an electrophotographic method for forming a color image of a multi-color type, there has been proposed an apparatus wherein charging, imagewise exposure and developing for each color are performed in succession within one rotation of a photoreceptor to form a color image. An image forming apparatus of this kind makes it possible to form an image at high speed. However, such apparatus has technical problems that plural sets, each including a charging unit, an imagewise exposure means and a developing unit need to be arranged within the circumference of a circle of the photoreceptor, there is a possibility that an optical system which conducts imagewise exposure is contaminated with toner leaking out of the developing unit which is located close to the optical system, resulting in deterioration of image quality, and it is necessary for avoiding the problem mentioned above to take a big gap between the imagewise exposure means and the developer, which inevitably requires a greater diameter of the photoreceptor, which results in a contradiction that an apparatus is large in size.

For the intent of avoiding the technical problems mentioned above, there has been proposed (Japanese Patent Publication Open to Public Inspection No. 307307/1993 (hereinafter referred to as Japanese Patent O.P.I. Publication)) an apparatus of the type wherein a base of a photoreceptor is made of transparent material and plural imagewise exposure means are housed inside the base so that a photoconductive layer formed on the outer circumferential surface of the photoreceptor may be exposed to an image through the base.

Since the image forming apparatus of this kind (see Japanese Patent O.P.I. Publication No. 307307/1993) is capable of forming a color image while the photoreceptor makes one turn, it is possible to record at high speed by shortening a period of image recording, and it is effective also for an improvement of image quality. There has also been proposed an apparatus of a type (hereinafter referred to as an optical-system-housed type) wherein line-shaped imagewise exposure means each being for each color are arranged inside a photoreceptor composed of a transparent base and a photoconductive layer. An image forming apparatus having therein imagewise exposure means of the optical-system-housed type has its advantage that a photoreceptor can be made small and thereby the apparatus can be made compact.

Further, in the case of an exposure light source wherein light-emitting elements such as LEDs, for example, are arranged to be line-shaped, when the light source is turned on for imagewise exposure, the light-emitting elements or an IC for driving the light-emitting elements generates heat. Such heat generation makes the temperature in the apparatus to be raised. On the other hand, the depth of focus of a lens array of a distributed refractive index type used in an exposure optical system is extremely short in general. Therefore, when a photoreceptor and a holding member that holds light-emitting elements of the exposure optical system are deformed by temperature rise in the apparatus caused by heat generated by the light-emitting elements or exposure elements, there is caused a technical problem that the deformation causes slipping of an image-forming plane of the exposure optical system, which results in shift of focus that causes formation of blurred images.

On the other hand, some of image forming apparatuses wherein toner images each having a different color are superimposed for image formation while a photoreceptor rotates are provided with exposure units each being for each color. The full color can be reproduced with, for example, yellow, magenta, cyan and black. When an exposure light source wherein light-emitting elements are arranged to be line-shaped on a base plate is turned on generally for imagewise exposure, the light-emitting elements and ICs for driving the light-emitting elements generate heat. When such generation of heat causes temperature rise on the base plate, the temperature rise caused by the heat generation causes deformation of the base plate, causing slipping of an image-forming position of each exposure optical system. Such phenomenon causes a technical problem that color slipping is caused on a color image.

SUMMARY OF THE INVENTION

The first object of the invention is, in view of the technical problems mentioned above, to provide an image forming apparatus capable of forming well-focused and sharp images.

The second object of the invention is, in view of the technical problems mentioned above, to provide an image forming apparatus capable of forming color images by restraining color slipping.

The objects mentioned above can be achieved by the following constitution.

Image forming apparatuses described in (1) through (4) are those wherein stipulation of an optimum thickness of a photoreceptor and of an optimum value of a distance between an inner surface of the photoreceptor and an end surface of an image forming element that constitutes an exposure optical system, can maintain the strength of the photoreceptor, and can restrain an increase in an amount of heat generated from an exposure unit, slipping of a writing position and a fall of brightness, and makes it easy to assemble the photoreceptor while maintaining the strength of the photoreceptor. Concrete constitution for this image forming apparatuses are as follows.

(1) An image forming apparatus having therein an exposure optical system provided therein with an exposure light source in which light-emitting elements are arranged on a base plate to be line-shaped and with a lens array of a distributed refractive index type that converges a beam emitted from the exposure light source on the surface of a photoreceptor and conducts imagewise exposure, wherein the following expressions are satisfied.

$$\left| \Delta T1 \times \left\{ R \times \alpha - \sum_i (Ri \times \alpha i) \right\} \right| \leqq F\ (\mu\mathrm{m})$$

In this case, ΔT1 represents a variation width (K) of the temperature in the vicinity of light-emitting elements, R represents a radius of the photoreceptor mentioned above, Ri represents a length (μm) of each member constituting the exposure optical system in the radial direction of the photoreceptor, a represents a coefficient of linear thermal expansion (°C.$^{-1}$) of a transparent base that forms the photoreceptor, $\alpha i$ represents a coefficient of linear thermal expansion (°C.$^{-1}$) of each member that constitute the exposure optical system, and F represents the depth of focus ($\mu$m) of the lens array.

(2) An image forming apparatus having in its photoreceptor mentioned above an exposure optical system in which an exposure light source having on its base plate light-emitting elements arranged to be line-shaped and an image forming element that converges a beam emitted from the exposure light source on the surface of the photoreceptor and conducts imagewise exposure, wherein the photoreceptor is formed to be of a thickness of 1–8 mm, and a distance between the inner surface of the photoreceptor and an end surface of the image-forming element is 0.5–10 mm.

(3) The image forming apparatus according to Item (2) above, wherein a light-emitting diode is used for the light-emitting element mentioned above and a lens array of a distributed refractive index type is used for the image forming element.

(4) The image forming apparatus according to Item (2) above, wherein inside diameter $\Phi$ of the photoreceptor represents $\Phi$=60–180 mm.

Image forming apparatuses described in (5) and (6) are those wherein dimensions and materials of various sections of a photoreceptor and an exposure optical system prevent that an image forming plane of the exposure optical system is slipped and blurred images are caused by the slipping of a focus position, even when the temperature inside the image forming apparatus is changed when the apparatus is operated, so that the slipping of the image forming position from the stipulated focus point can be 200 $\mu$m or less. Concrete constitution for the image forming apparatuses are as follows.

(5) The image forming apparatus according to Item (1) wherein image forming is suspended under the condition of $$\left| \Delta T1 \times \left\{ R \times \alpha - \sum_i (Ri \times \alpha i) \right\} \right| > 200(\mu\text{m}).$$

(6) The image forming apparatus according to Item (1) wherein there is provided a temperature control means that controls $\Delta$T1 so that $$\left| \Delta T1 \times \left\{ R \times \alpha - \sum_i (Ri \times \alpha i) \right\} \right| \leqq 200(\mu\text{m})$$

is satisfied.

Image forming apparatuses described in (7) through (11) are those wherein color slipping caused during formation of a color image by great expansion of a base plate caused by heat generated by light-emitting elements themselves or IC for driving the light-emitting elements when the light-emitting elements are turned on and by big difference in writing positions of plural sets of exposure optical systems, is restrained to several tens $\mu$m. Concrete constitution for the image forming apparatuses are as follows.

(7) An image forming apparatus having therein plural sets each being composed of an exposure light source constituting light-emitting elements arranged on a base plate to be line-shaped, an exposure optical system which forms a latent image on a photoreceptor with light from the exposure light source, and of a developing unit, and forming an image by superimposing toner images on the photoreceptor through repetition of a cycle that imagewise exposure is given to the photoreceptor, and a toner image is formed on the photoreceptor by the developing means, wherein the following expressions are satisfied.

$$\alpha j \times L \times \Delta T2 \leqq M/2 \text{ pixel}$$

In the above expression, $\alpha$j represents a coefficient of linear thermal expansion (°C.$^{-1}$) of a material employed for forming a base plate, L represents a length ($\mu$m) of a base plate in the axial direction of a photoreceptor, $\Delta$T2 represents a temperature difference between 20° C. and the temperature in the vicinity of light-emitting elements, and M represents a length ($\mu$m) of one pixel of the image in the axial direction of the photoreceptor.

(8) The image forming apparatus according to Item (7) wherein the base plate is made of a material whose coefficient of linear thermal expansion is $20\times10^{-6}$°C.$^{-1}$ or less.

(9) The image forming apparatus according to Item (7) which is used when the temperature in the vicinity of light-emitting elements is within a range of 0°–60° C.

(10) The image forming apparatus according to Item (7) wherein image forming is stopped in the case of $\alpha j \times L \times \Delta T2 > ½$ pixel.

(11) The image forming apparatus according to Item (7) wherein a temperature control means that controls $\Delta$T2 is operated so that $\alpha j \times L \times \Delta T2 > ½$ pixel can be satisfied.

DETAILED DESCRIPTION OF THE INVENTION

Figure 1:
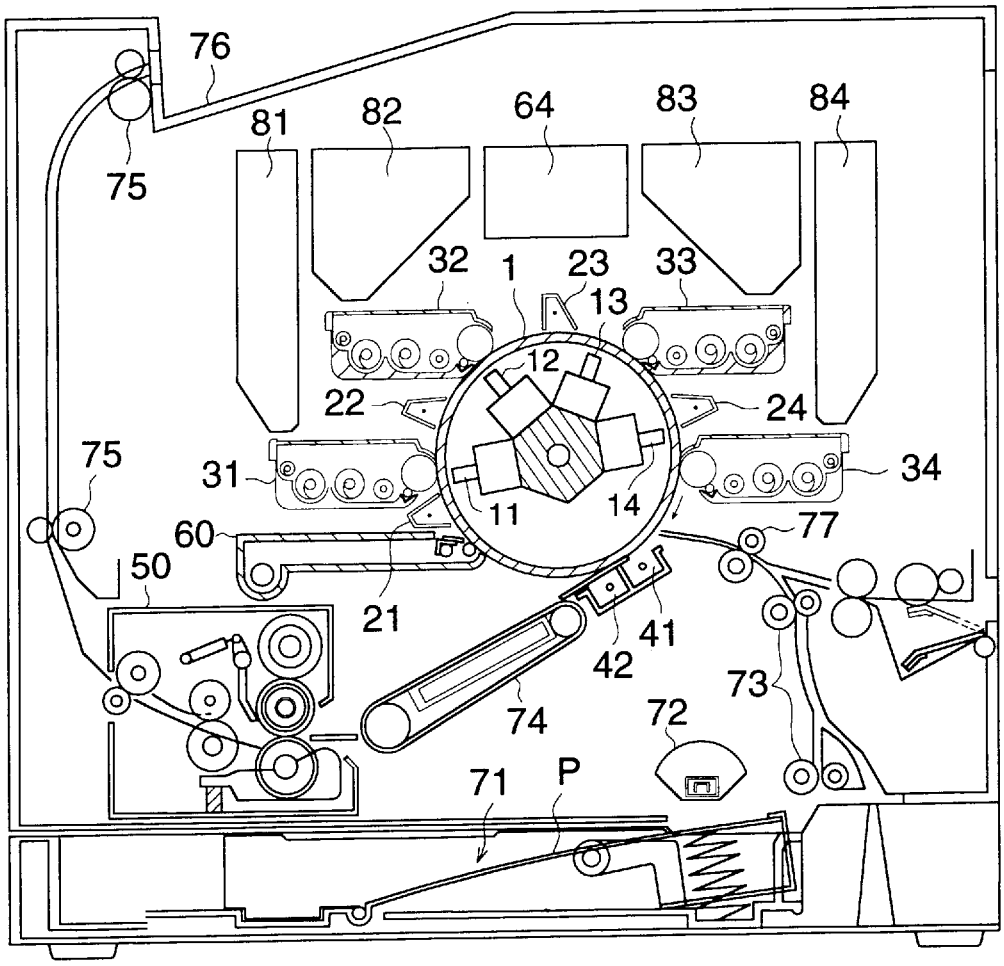
FIG. 1 is a sectional view showing a schematic constitution of an image forming apparatus in the present embodiment.

As shown in FIGS. 1 through 4, an image forming apparatus in the present embodiment is of construction wherein cylindrical photoreceptor 1 is provided, and imagewise exposure units 11–14 are arranged inside the photoreceptor 1, while image forming process means including charging units 21–24, developing units 31–34, transfer unit 41, separating unit 42, fixing unit 50 and cleaning unit 60 are arranged around the photoreceptor 1, and paper cassette 71, paper feed roller 72, conveyance roller 73, conveyance belt 74, exit roller 75, and copy tray 76 are arranged as a paper feed mechanism. While the photoreceptor 1 makes one turn, a yellow toner image, a magenta toner image, a cyan toner image and a black toner image are formed to be superimposed, then, these color toner images are transferred by the transfer unit 41 onto a recording sheet, then, the recording sheet is separated from the photoreceptor 1 by the separating unit 42 to be conveyed by the conveyance belt 74 to the fixing unit 52 where the color toner images held on the recording sheet are fixed permanently thereon, thus, the recording sheet is ejected with its face facing upward on the copy tray 76 through the exit rollers 75. Before explaining an outline of the structure of each section, a summary of a color image forming process in the image forming apparatus in the present embodiment will be explained as follows.

First, with the start for image recording, a driving motor (not shown) rotates to turn photoreceptor 1 clockwise, and simultaneously with this, scorotron charging unit 21 provided on the left of the photoreceptor 1 starts giving electric potential, through its charging action, to the photoreceptor 1. After this charging process, imagewise exposure unit 11 starts exposure with electric signals corresponding to yellow image signals, and an electrostatic latent image corresponding to a yellow image in an original image is formed on a photoconductive layer on the surface of the photoreceptor 1 through rotary scanning therefor.

The electrostatic latent image formed on the photoreceptor 1 through the exposure process mentioned above is subjected to reversal development which is conducted on a non-contact basis with developing agents carried by a developing sleeve of the developing unit 31 so that the electrostatic latent image may be visualized as a yellow toner image.

Then, as the photoreceptor 1 rotates, charging unit 22 gives electric potential, through its charging action, on the yellow toner image which has already been held on the photoreceptor 1, then, exposure by means of electric signals corresponding to a magenta image signals is given thereon by imagewise exposure unit 12, thus, a magenta toner image is formed to be superimposed on the yellow toner image through non-contact type reversal development conducted by developing unit 32.

In the same process as in the foregoing, a cyan toner image is formed to be superimposed by charging unit 23, imagewise exposure unit 13 and developing unit 33. Consequently, a black toner image is formed to be superimposed. successively by charging unit 24, imagewise exposure unit 14 and developing unit 34, thus, a color toner image is formed on the circumferential surface of the photoreceptor 1 within a period of one rotation thereof.

Transfer sheet P is fed out of paper cassette 71 and is conveyed to timing roller 77. The color toner image formed on the circumferential surface of the photoreceptor 1 is transferred, at the transfer unit 41, onto the transfer sheet P which is conveyed, through operation of the timing roller 77, in synchronization with the toner image on the photoreceptor 1.

The transfer sheet P onto which the toner image has been transferred is neutralized in terms of electric charge and is separated from the circumferential surface of the photoreceptor 1 in separating unit 42, and then is transported to fixing unit 50 by conveyance belt 74 that is a conveyance means. In the fixing unit 50, the transfer sheet is heated and pressed so that toner may be fused and fixed on the transfer sheet P, then it is ejected out of the fixing unit 50 to be conveyed by a pair of exit conveyance rollers so that it may be ejected on copy tray 76 located on the top of the apparatus with its toner image side facing downward, through exit rollers 75.

On the other hand, the photoreceptor 1 from which the transfer sheet P has been separated is scraped on its surface by cleaning blade 61 in cleaning unit 60 so that residual toner may be removed and cleaned, to be ready either for continuation of formation of toner images for images of the same original or for formation of toner images for images of another original after momentary suspension. Waste toner scraped off by cleaning blade 61 and cleaning roller 62 is ejected to waste toner container 64 through toner conveyance screw 63 and an unillustrated toner conveyance pipe. After completion of cleaning, the cleaning blade 61 and the cleaning roller 62 are kept to be away from the photoreceptor 1 to prevent damage of the photoreceptor 1.

The foregoing is an outlined constitution of a color image forming process in an image forming apparatus of the present embodiment.

Next, an image forming apparatus in the present embodiment will be explained as follows, focusing on optimum values for the wall thickness and operating distance of a photoreceptor and on the arrangement for solving the technical problem that deformation of a photoreceptor and an exposure optical system resulted from temperature rise in the apparatus caused by heat generated by a light-emitting elements or an exposure element causes slipping of an image-forming plane of the exposure optical system, and thereby a blurred image is formed by focus slipping and the technical problem that color slipping is caused on a color image by a phenomenon that each exposure optical system has different writing position in an image forming apparatus equipped with plural exposure units.

Photoreceptor 1 is a cylindrical photoconductor drum wherein a cylindrical base body (this is called a transparent base body) is made with a transparent member such as transparent acrylic resin or the like, for example, and a photoconductive layer such as a transparent conductive layer, an a-Si layer or an organic photoconductive layer (OPC) is formed on the outer circumferential surface of the transparent base body, and its outside diameter $\phi$ and its wall thickness t are made respectively to be 80 mm and 3 mm by a centrifugal polymerization method. This photoreceptor 1 is arranged, while being grounded, at the center of an apparatus to be rotatable freely, and it rotates clockwise in FIG. 1.

Since the photoreceptor 1 in the present embodiment is to be exposed by imagewise exposure units 11–14 arranged inside the photoreceptor as described above, it is necessary to give appropriate potential contrast to the photoconductive layer by making the transparent base body with a material that transmits light. However, the base body does not need to be 100% in terms of light transmission factor, and it may also be of characteristics that a certain percentage of light is absorbed while the beam emitted from each of imagewise exposure units 11–14 is being transmitted. The transparent base body of this kind is manufactured from acrylic copolymer through a centrifugal polymerization method.

Owing to the foregoing, it is possible to manufacture a cylindrical base body having hardness comparable to aluminum, light transmission factor of 90% or more, and shock resistance which is about 15 times that of glass. In the method mentioned above, photoreceptor 1 whose coefficient of linear thermal expansion $\alpha$ is $80\times10^{-6}$° C.$^{-1}$ at 20° C. can be obtained. The coefficient of linear thermal expansion $\alpha$ means a rate of change (°C.) in length per 1° C. of temperature, and measuring methods therefor are stipulated for various materials in JIS. An example thereof is JIS K 7197.

Incidentally, when an inside diameter $\phi$ of photoreceptor 1 is made smaller than 60 mm, it is not possible to obtain a circumferential length which can accommodate process members described later, while when an inside diameter $\phi$ of photoreceptor 1 is larger than 180 mm, it is not possible to make the total apparatus to be size small in size.

Further, when thickness t of a transparent base body of photoreceptor 1 is made smaller than 1 mm, it is not possible to obtain sufficient strength capable of standing a distortion generated when a contact roll on each of developing units 31–34 comes in contact with the transparent base body. When imagewise exposure is made under the condition mentioned above, slipping in image forming is caused for each of imagewise exposure units 11–14. When thickness t of a transparent base body of photoreceptor 1 is made larger than 8 mm, on the other hand, light-emitting intensity of light-emitting element 110 needs to be made higher, which results in a larger amount of heat generated from the light-emitting elements 110 and IC 142 for driving use. When an amount of generated heat is large, a base plate on which light-emitting elements are arranged and a holding member which holds SELFOC lens are deformed and slipping in image forming position and a fall of brightness are caused, which will be described later. It is therefore preferable that the thickness of the transparent base body is within a range of 1 mm–8 mm.

As a material for a base body having the transmission factor satisfying the conditions mentioned above, acrylic resin, especially one polymerized by using methylester-monomer methacrylate is excellent in terms of transparency, strength, accuracy and surface property, and it is used preferably. In addition, it is possible to use various light-transmitting resins such as fluorine, polyester, polycarbonate and polyethyleneterephthalate used for general optical members.

As a conductive layer, a metallic foil maintaining light-transmitting property made of indium/tin/oxide (ITO), tin oxide, zinc oxide, indium oxide, copper iodide, Au, Ag, Ni or Al is used, and as a casting method, there are used a vacuum deposition method, an activated reaction deposition method, various spattering methods, various CVD methods, a dip coating method and a spray coating method. As a photoconductive layer, a photoconductive layer of amorphous silicon (a–Si) alloy, a photoconductive layer of amorphous selenium alloy and various organic photoconductive layers (OPC) can be used.

Imagewise exposure units 11–14 represent a line-shaped imagewise exposure means wherein there are provided light-emitting elements 110 arranged to be straight-line-shaped in the axial direction of photoreceptor 1 and a lens array of a refractive index distributed type (e.g., SELFOC lens made by Nihon Flat Glass Co. which will be abbreviated as SLA hereinafter) which serves as an image forming element, and whereby distance l between an inner surface of the photoreceptor 1 and an end face of an image forming element of an exposure optical system is made to be about 2 mm. In the imagewise exposure units 11–14, it is possible to restrain fluctuation of writing position and a fall of brightness, owing to the arrangement that the photoreceptor 1 is made through a centrifugal polymerization method so that outside diameter $\phi$ is 80 mm and wall thickness t is 3 mm, and distance l from image forming element 120 to an inner surface of the photoreceptor 1 is in the optimum range of about 2 mm, and whereby an amount of heat generated in the exposure optical system is restrained to the optimum value.

Incidentally, when distance l between the photoreceptor 1 and an end face of SLA 120 is made to be 0.5 mm or less, an opportunity that both of them touch each other and are damaged is increased in the course of assembling the apparatus. On the other hand, when this distance l is made to be longer than 10 mm, an amount of heat generated from light-emitting elements 110 and from IC 142 for driving the light-emitting elements 110 is increased because light-emitting intensity of the light-emitting elements 110 needs to be made higher, which is a problem.

In the present embodiment, the imagewise exposure units 11–14 are of the same structure, and therefore, each of them is symbolized as imagewise exposure unit 100 and the structure of each portion thereof will be explained in detail, referring to FIGS. 2–4.

Figure 2:
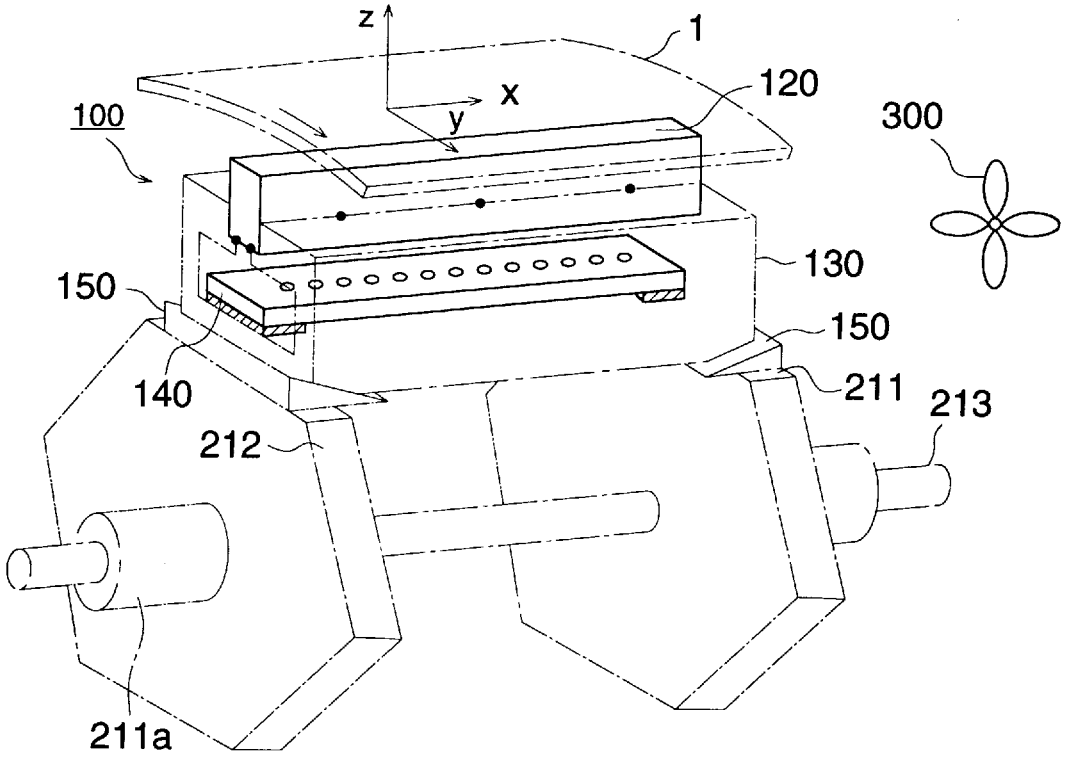
FIG. 2 is a perspective view of an imagewise exposure unit in the present embodiment.
Figure 3:
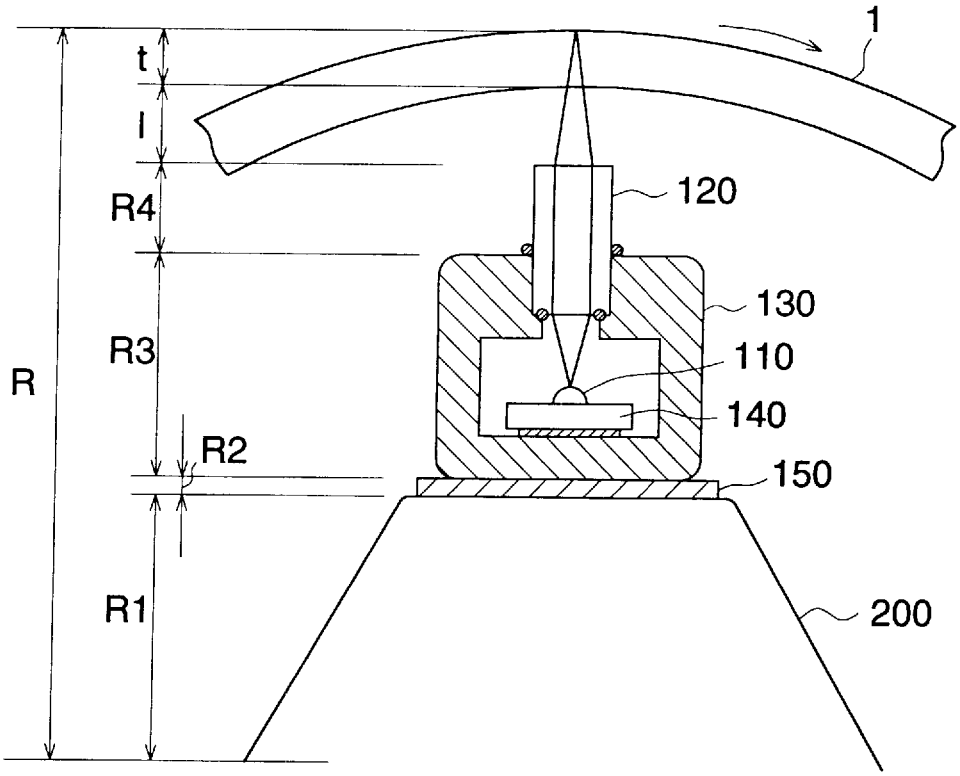
FIG. 3 is a sectional view of primary portions of the imagewise exposure unit.

The imagewise exposure unit 100 is structured as a unit mounted on holding member 130 which holds light-emitting elements 110 arranged in the axial direction of the photoreceptor 1, IC 142 for driving the light-emitting elements 110 and SELFOC lens 120 as shown in FIGS. 2 and 3, and it is mounted on optical system supporting body 200 that holds fixedly exposure units housed in the photoreceptor 1, and image signals for each color stored in a memory are read out of the memory in succession to be inputted in exposure unit 100 for each color as electric signals.

Figure 4:
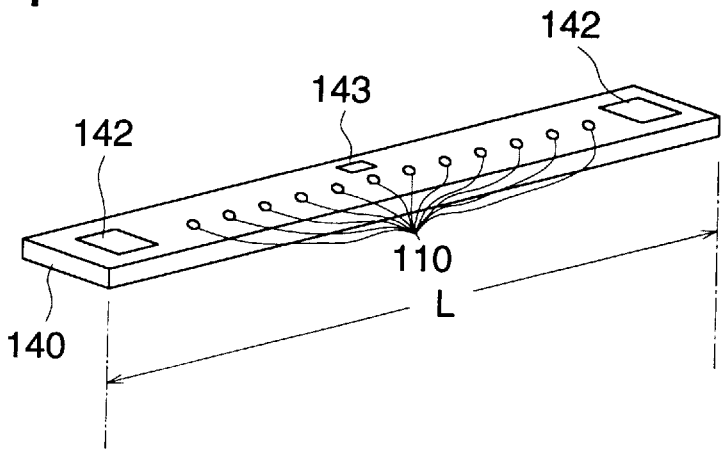
FIG. 4 is a perspective view showing a base plate on which light-emitting elements are arranged in a line shape.

The light-emitting elements 110 represent an array wherein LEDs (light-emitting diode). which emit light with wavelength of 600–900 nm, for example, are arranged in a line shape as shown in FIG. 4, and the array is formed on base plate 140 employing, for example, Pyrex glass whose coefficient of linear thermal expansion $\alpha 2$ at 20° C. is $3.6\times10^{-6}$ °C.$^{-1}$. Further, SLA 120 is stuck to holding member 130 with adhesives represented by black and small circles in the figure, and base plate 140 for light-emitting elements 110 is stuck to holding member 130 with adhesives represented by hatchings in the figure.

For the intent of making the focal length of SLA 120 to be short, SLA-20 or SLA 20BS made by Nihon Flat Glass Co., for example, are used, and thereby an amount of light that reaches the photoreceptor 1 is made to be large so that an amount of emission of light-emitting elements 110 themselves can be reduced. In the present embodiment, amount of color slipping D can mostly be represented by the following Expression (1).

$$D=\alpha j\times L\times \Delta T2 \quad (1)$$

In this case, $\alpha$j represents a coefficient of linear thermal expansion of a material employed for forming base plate 140, L is a length of the base plate 140 in the axial direction of a photoreceptor as shown in FIG. 4, and $\Delta$T2 represents a temperature difference between the temperature in the vicinity of the light-emitting elements 110 and 20° C. When forming a color image, if the pixel slipping in terms of a length is kept within a half of a pixel in size, it is generally considered that an excellent image can be obtained. Therefore, it is possible to provide, by satisfying aforesaid $\alpha j\times L\times \Delta T2<½$ pixel, a color image forming apparatus capable of producing an excellent color image with no color slipping.

An image forming apparatus in the present embodiment is established so that amount of color slipping D is 0 when the temperature in a room is 20° C., and when the temperature in the vicinity of the light-emitting elements 110 fluctuates within a range from 20° C. to 10° C. which is an ordinary condition for usage, $\Delta$T2 is 10° C., and when assuming that $\alpha 1$ at 20° C. is $20\times10^{-6}$°C.$^{-1}$ and L is 240 mm that corresponds to A4 size, amount of color slipping D is about 50 $\mu$m from Expression (1), which means that D≦½ pixel can not be satisfied when the value of coefficient of linear thermal expansion of base plate 140 is greater than $20\times10^{-6}$°C.$^{-1}$, if the image forming apparatus is one with 300 dpi wherein a size of a pixel is about 80 $\mu$m, which results in a problem of color slipping.

When the temperature in the vicinity of the light-emitting elements 110 is lower than 0° C., light-emitting elements do not operate properly, and when it exceeds 60° C. on the contrary, amount of color slipping D becomes too large. A temperature of this kind is sometimes generated when an image forming apparatus is used continuously. On the base plate 140 in the present embodiment, therefore, there is provided temperature sensor 143 at the central portion of light-emitting elements 110 arranged in a line shape as shown in FIG. 4 so that the temperature in the vicinity of the light-emitting elements can be detected.

An image forming apparatus in the present embodiment is equipped with a microprocessor (not shown) for executing mainly the image forming process, and this microprocessor detects the temperature in the vicinity of light-emitting element 110 by referring to detection signals from temperature sensor 143 provided on the base plate 140. Since the microprocessor contains also a program for calculating the Expression (1) above, if it is detected that an amount of color slipping exceeds ½ pixel, the base plate 140 can be cooled either by stopping the image forming process mentioned above or by driving fan 300 that represents a cooling means.

Coefficient of linear thermal expansion α14 of SLA 120 is determined by FRP constituting the SLA 120, and a value of the coefficient of linear thermal expansion α14 at 20° C. is $10\times10^{-6}$°C.$^{-1}$, and the SLA 120 is protruded from holding member 130 by a length of R14 (=3 mm) in the radial direction of the photoreceptor as shown in FIG. 3.

The holding member 130 is made of polycarbonate containing 30% of glass fiber whose coefficient of linear thermal expansion α13 at 20° C. is $80\times10^{-6}$°C.$^{-1}$, and is formed so that its length R13 in the radial direction of the photoreceptor is 18 mm.

Incidentally, in the present embodiment, light-emitting elements 110 are explained to be one wherein LEDs are arranged in a line shape. However, the invention is not limited to this, and it is possible to obtain the same effect with a line-shaped exposure element wherein light-emitting elements such as, for example, FL (fluorescent substance emission), EL (electroluminescence) or PL (plasma discharge) are arranged in a line shape, or with one wherein elements having an optical shutter function such as LISA (photo-electro-magnetic effect optical shutter), PLZT (transparent piezoelectric element shutter array) or LCS (liquid crystal shutter) are arranged.

Optical system supporting body 200 is provided with two optical system supporting members 211 and 212 located respectively at right and left to support both ends of imagewise exposure units 11–14, and shaft 213 is inserted in the center of the supporting members to support them. Both ends of the imagewise exposure units 11–14 are mounted on the outer circumferential surface of the optical system supporting members 211 and 212 to be fixed thereon. In the present embodiment, the optical system supporting body 200 is made of aluminum whose coefficient of linear thermal expansion all at 20° C. is $24\times10^{-6}$°C$^{-1}$, and is formed so that its shortest length R11 from the center of the photoreceptor to the supporting surface where the supporting member 130 is supported, is 12 mm.

In the present embodiment, a pair of supporting portions of the optical system supporting members 211 and 212 on which both ends of each of the imagewise exposure units 11–14 are mounted to be fixed are represented by the side of a regular hexagonal prism, and these sides are aligned on a surface plate to be on the same plane in advance. However, these optical system supporting members may also be molded solidly, and their shapes are not limited. Each of the imagewise exposure units 11–14 is subjected to position adjustment, and then is fixed with adhesives through wedge-shaped spacer 150 which is made of acrylic resin whose coefficient of linear thermal expansion α12 at 20° C. is $70\times10^{-6}$°C.$^{-1}$, so that length R12 in the radial direction of the photoreceptor is 2 mm.

The foregoing represents outlined dimensions and materials of each portion of the imagewise exposure unit 100 in the present embodiment, and the relation between those mentioned above and image forming slipping of the imagewise exposure unit 100 can be represented mostly by the following Expression (2).

Image forming slipping of exposure unit $$\Delta 1 \approx \left| \Delta T1 \times \left\{ R \times \alpha - \sum_{i=1}^{4} (Ri \times \alpha i) \right\} \right| = \left| \Delta T1 \times \{R \times \alpha - (R1 \times \alpha 1 + R2 \times \alpha 2 + R3 \times \alpha 3 + R4 \times \alpha 4)\} \right| \quad (2)$$

In the above expression, ΔT1 represents variation width (K) in the vicinity of light-emitting elements, R represents a radius (μm) of a photoreceptor, R11 represents the shortest distance (μm) from the center of the photoreceptor to the supporting surface where the spacer 150 is glued in the optical system supporting body 200, R12 is a length (μm) of spacer 150 in the radial direction of the photoreceptor, R13 is a length (μm) of holding member 130 that holds SLA 120 in the radial direction of the photoreceptor, R14 is a length (μm) in the radial direction of the photoreceptor by which the SLA 120 is protruded toward the image forming point from holding member 130, α is a coefficient of linear thermal expansion (°C.$^{-1}$) of a material forming a transparent base body of the photoreceptor, α11 is a coefficient of linear thermal expansion (°C.$^{-1}$) of a material forming optical system supporting body 200, α12 is a coefficient of linear thermal expansion (°C.$^{-1}$) of a material forming spacer 150, α13 is a coefficient of linear thermal expansion (°C.$^{-1}$) of a material forming the holding member 130, and α14 is a coefficient of linear thermal expansion (°C.$^{-1}$) of a material forming the SLA 120.

When using SLA for an image forming element, the depth of focus of SLA is ±200 μm in general. Therefore, it is necessary that focus slipping is 200 μm or less. It is therefore possible to provide an image forming apparatus capable of obtaining a well-focused sharp image by satisfying aforesaid expression $$\left| \Delta T1 \times \left\{ R \times \alpha - \sum_{i} (Ri \times \alpha i) \right\} \right| \leqq 200(\mu m).$$

In the present embodiment, applicable temperature ranges from 0° C. to 60° C., and when the temperature in the initial state is 20° C., ΔT1=40 (K) is satisfied, wherein when ΔT1 is calculated using Expression (2), the ΔT1 thus obtained is about 130 μm. Therefore, if the members selected in the present embodiment are used, image forming slipping can be restrained to 200 μm or less and excellent images can be obtained.

An image forming apparatus in the present embodiment is equipped with a microprocessor (not shown) for executing mainly the image forming process, and this microprocessor detects the temperature in the vicinity of light-emitting elements 110 by referring to detection signals from temperature sensor 143 provided on the base plate 140. Since the microprocessor contains also a program for calculating the Expression (2) above, if it is detected that image forming slipping ΔT1 of exposure unit 100 fluctuates exceeding ±200 μm, the microprocessor can control the ΔT1 either by stopping the image forming process mentioned above or by driving fan 300 that represents a temperature control means.

Each of charging units 21–24 is a scorotron charger that charges a photoconductive layer of photoreceptor 1 by means of a control grid that is kept at a prescribed voltage and of corona discharge made by a corona wire, and thereby gives a uniform voltage to the photoreceptor 1.

Developing units 31–34 respectively contain yellow (Y), magenta (M), cyan (C) and black (K) single-component or two-component developing agents, and are equipped with developing sleeves each rotating in the same direction as that of the photoreceptor 1 while being kept to be away from the circumferential surface of the photoreceptor 1 by a prescribed clearance. Each of the developing units 31–34 is kept by unillustrated rolls to be away from the photoreceptor 1 by a clearance of a prescribed value, for example, of 100 μm–1000 μm on a non-contact basis, and when each of developing units 31–34 for each color is operated for developing, D.C. developing bias voltage or D.C. developing bias voltage plus A.C. developing bias voltage are given to the developing sleeve so that non-contact development is conducted by single-component or two-component developing agents contained in the developing unit. Then, D.C. bias voltage whose polarity is the same as that of toner is impressed on photoreceptor 1 having thereon a grounded transparent conductive layer so that there may be conducted non-contact reversal development for applying toner on an exposed portion. Toner for replenishment for each color is supplied from each of toner replenishing tanks 81–84 to each of developing units 31–34 corresponding to that color.

The present invention has made it possible, by having aforesaid constitution, to provide an image forming apparatus which can form a well-focused sharp image.

Further, the present invention has made it possible, by having aforesaid constitution, to provide an image forming apparatus which can form a color image by restraining color slipping.

What is claimed is:

1. An image forming apparatus, comprising:

a photoreceptor having a base;

an exposure optical system including:

a) an exposure light source, having light-emitting elements arranged linearly, for emitting a light beam;

b) a lens array for focusing said light beam onto a surface of said photoreceptor; and c) a supporting member for supporting said exposure light source and said lens array;

wherein said exposure optical system is arranged in relation to said photoreceptor, satisfying the following function:

$$\left| \Delta T1 \times \left\{ R \times \alpha - \sum_i (Ri \times \alpha i) \right\} \right| \leqq F$$

wherein ΔT1 represents a variation width (K) of the temperature in the vicinity of said light-emitting elements, R represents a radius (am) of said photoreceptor, Ri represents a length (μm) of each member constituting said exposure optical system in the radial direction of said photoreceptor, α represents a coefficient of linear thermal expansion (°C.$^{-1}$) of said base member of said photoreceptor, αi represents a coefficient of linear thermal expansion (°C.$^{-1}$) of each member constituting said exposure optical system, and F represents the depth of focus (μm) of said lens array.

2. The apparatus of claim 1, wherein said exposure optical system is accommodated inside said photoreceptor; a thickness of said base member of said photoreceptor is between 1 mm and 8 mm; and a distance between an inner surface of said base member and an end face of said lens array is between 0.5 mm and 10 mm.

3. The apparatus of claim 2, wherein said light-emitting elements are light-emitting diodes, and said lens array is of a distributed refractive index type.

4. The apparatus of claim 2, wherein an inside diameter Φ of said photoreceptor is between 60 mm and 180 mm.

5. The apparatus of claim 1, further comprising:

a control means for suspending an image forming operation of said image forming apparatus when said depth of focus F of said lens array exceeds 200 μm.

6. The apparatus of claim 1, further comprising:

a temperature control means for controlling said variation width ΔT1 of the temperature in the vicinity of said light-emitting elements so that the arrangement of said exposure optical system in relation to said photoreceptor satisfies the following function:

$$\left| \Delta T1 \times \left\{ R \times \alpha - \sum_i (Ri \times \alpha i) \right\} \right| \leqq 200\mu\text{m}.$$

7. An image forming apparatus, comprising:

a photoreceptor having a base for forming an image on a surface thereof;

an exposure optical system including:

a) light-emitting elements;

b) a base plate for linearly arranging said light-emitting elements; and c) a supporting member for supporting said base plate;

wherein said base plate is arranged, satisfying the following function:

$$\Delta j \times L \times \Delta T2 \leqq M/2$$

wherein αj represents a coefficient of linear thermal expansion (°C.$^{-1}$) of a material employed for forming said base plate, L represents a length (Δm) of said base plate in the axial direction of said photoreceptor, ΔT2 represents a temperature difference in the vicinity of said light-emitting elements, and M represents a length (μm) of one pixel of said image in the axial direction of said photoreceptor.

8. The apparatus of claim 7, wherein said base plate is made of a material having a coefficient of linear thermal expansion of $20\times10^{-6}$°C.$^{-1}$.

9. The apparatus of claim 7, wherein said light-emitting elements are used so that the temperature in the vicinity of said light-emitting elements is within a range between 0° C. and 60° C.

10. The apparatus of claim 7, further comprising:

a control means for suspending an image forming operation of said image forming apparatus when said length M of one pixel of said image in the axial direction of said photoreceptor exceeds 1 μm.

11. The apparatus of claim 7, further comprising:

a temperature control means for controlling said temperature difference ΔT2 in the vicinity of said light-emitting elements so that the arrangement of said base plate satisfies the following function:

$$\alpha j \times L \times \Delta T2 \leqq M/2.$$

* * * * *